US008490896B2

(12) United States Patent
Chen

(10) Patent No.: US 8,490,896 B2
(45) Date of Patent: Jul. 23, 2013

(54) GARDEN SPRAYER

(75) Inventor: Chin-Yuan Chen, Chang-Hua Hsien (TW)

(73) Assignee: Shin Tai Spurt Water of the Garden Tools Co., Ltd., Lane Liau Tsuoh, Lu-Kang Town, Chang-Hua Hsien (TW)

( * ) Notice: Subject to any disclaimer, the term of this patent is extended or adjusted under 35 U.S.C. 154(b) by 194 days.

(21) Appl. No.: 13/181,503

(22) Filed: Jul. 12, 2011

(65) Prior Publication Data

US 2013/0015271 A1 Jan. 17, 2013

(51) Int. Cl.
*B05B 9/01* (2006.01)

(52) U.S. Cl.
USPC ..... 239/526; 239/443; 239/583; 239/459; 239/456

(58) Field of Classification Search
USPC ..... 239/526, 443, 583, 459, 456
See application file for complete search history.

(56) References Cited

U.S. PATENT DOCUMENTS 2,991,945 A * 7/1961 Rosenkranz ..... 239/459
4,219,162 A * 8/1980 Dadson ..... 239/583
6,427,931 B1 * 8/2002 Guo ..... 239/526

* cited by examiner

*Primary Examiner* — Dinh Q Nguyen

(57) ABSTRACT

A garden sprayer includes: comprises a main body, a spray head, a control valve set, a pressing handle and a fastening device. The fastening device is pivoted on the main body adjacent to the pressing handle. The fastening device has at least two brackets and a pressing rod connecting the two brackets. The pressing rod of the fastening device pushes against the third locking edge of the pressing handle to hold down the pressing handle for a constant water flow without the pressing handle needing to be pressed by the user. When the pressing handle is held down, the cover of the spray head can be rotated to adjust a gap between the spraying aperture of the cover and the head portion to adjust the water flow rate.

10 Claims, 7 Drawing Sheets

GARDEN SPRAYER

BACKGROUND OF THE INVENTION

1. Field of the Invention

The present invention relates to a garden sprayer, and more particularly to a garden hose sprayer capable of providing a constant water output and an adjustable flow without pressing of a handle.

2. Description of the Related Art

Most sprayers are designed to be controlled by way of a manual pressing force; therefore, users need to keep pressing a handle to keep the water outflowing. Therefore, it becomes uncomfortable for the user and it is also difficult for the user to maintain the same pressing strength. Although some sprayers can be adjusted to provide a constant flow without being pressed, the output flow in such sprayers is not adjustable.

Therefore, it is desirable to provide a garden sprayer structure to mitigate and/or obviate the aforementioned problems.

SUMMARY OF THE INVENTION

An objective of the present invention is to provide a garden sprayer structure.

In order to achieve the above-mentioned objectives, a garden sprayer comprises: comprises a main body, a spray head, a control valve set, a pressing handle and a fastening device. The main body has a hand-held tube, the hand-held tube is covered by an anti-slip cover and has a pivoting base at a rear end; the pivoting base has a shaft aperture; a flow tube is connected to an upper end of the hand-held tub, the flow tube has a first locking edge at an end; an assembling aperture is disposed at an opening face of the main body, a pivoting portion is formed adjacent to the assembling aperture, and the pivoting portion has a through aperture; a spray head has a cover and a head portion, the cover has a first containment space, the first containment space having a threaded section and a spraying aperture; the head portion is hollow and has a second containment space, the second containment space has a second locking edge, the second locking edge is engaged with the first locking edge of the main body, the second containment space further has a respective outlet aperture at each side and an adjusting thread section adjacent to the outlet aperture, and the adjusting thread section is secured onto the threaded section of the cover; a control valve set has a valve member, a securing member and an elastic member, the valve member has a plug formed at an end, the plug is insertable to seal the second containment space, the valve member further has an extended rod at another end, the extended rod has a securing section, the securing member has a first engaging slot and a threaded aperture, the threaded aperture engages with the securing section of the extended rod, the elastic member jackets onto the extended rod of the valve member, the elastic member pushes against an opening side of the flowing tube of the main body and the valve member; a pressing handle has a handle portion, the handle portion is covered by an anti-slip pad and has a through hole above an opening of the handle portion, the through hole accepts the securing member, the through hole further has a second engaging slot, the second engaging slot engages with the first engaging slot of the securing member and has a pivoting aperture on a side, the pivoting aperture is provided with a pin, the pin passes through the shaft aperture of the pivoting base and has a third locking edge adjacent to the pivoting aperture; and a fastening device comprises at least two brackets and a pressing rod connecting the two brackets, an engaging rib is formed on an inner side of the bracket, the engaging rib is pivoted onto the through aperture of the pivoting portion of the main body, and the pressing rod pushes against the third locking edge of the pressing handle.

With the above-mentioned embodiment, the following benefits can be obtained: 1. During the spraying, the pressing rod of the fastening device escapes from the third containment space of the main body and the pressing rod of the fastening device pushes against the third locking edge of the pressing handle to hold down the pressing handle for a constant water flow without the pressing handle needing to be pressed by the user. 2. When the pressing handle is held down, the cover of the spray head can be rotated to adjust a gap between the spraying aperture of the cover and the head portion to adjust the water flow rate.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
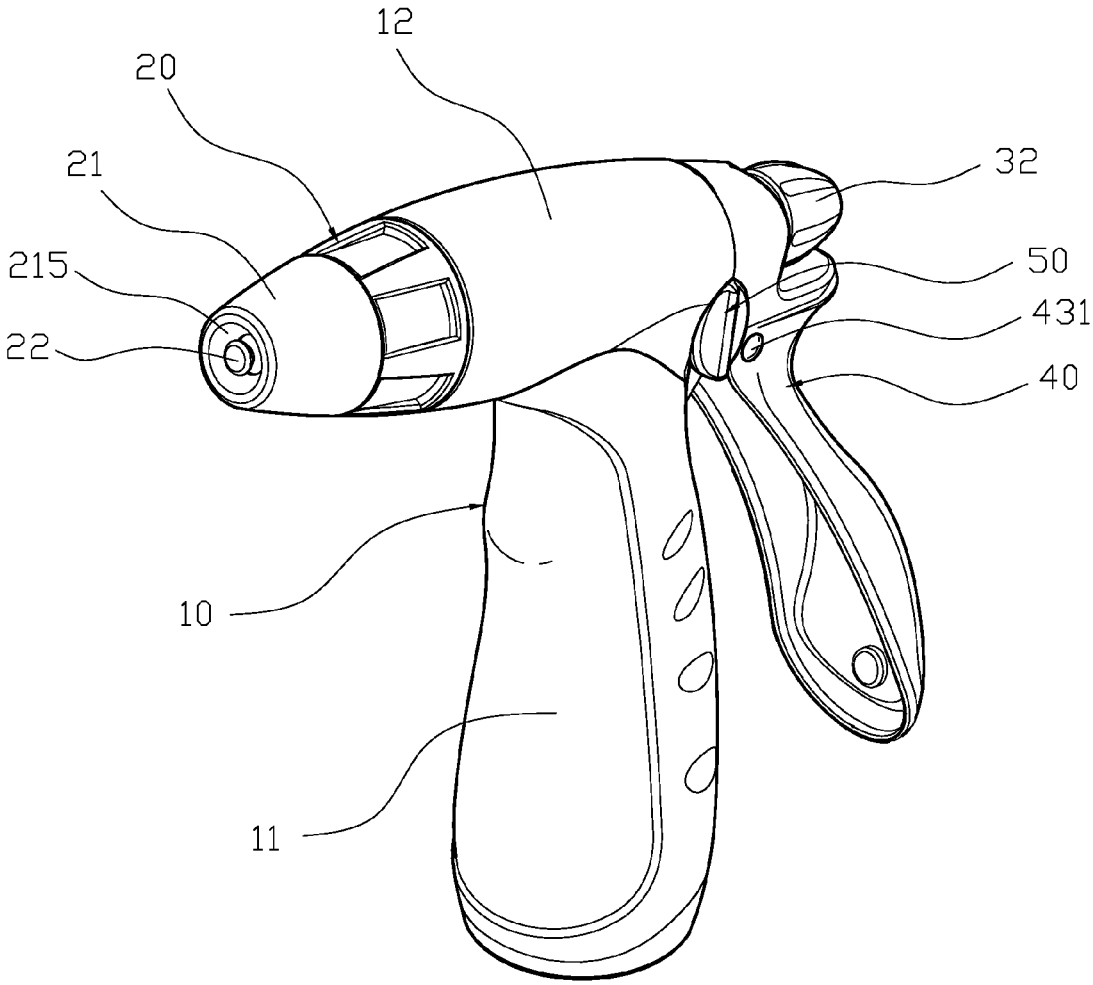
FIG. 1 is a perspective view of an embodiment of the present invention.
Figure 2:
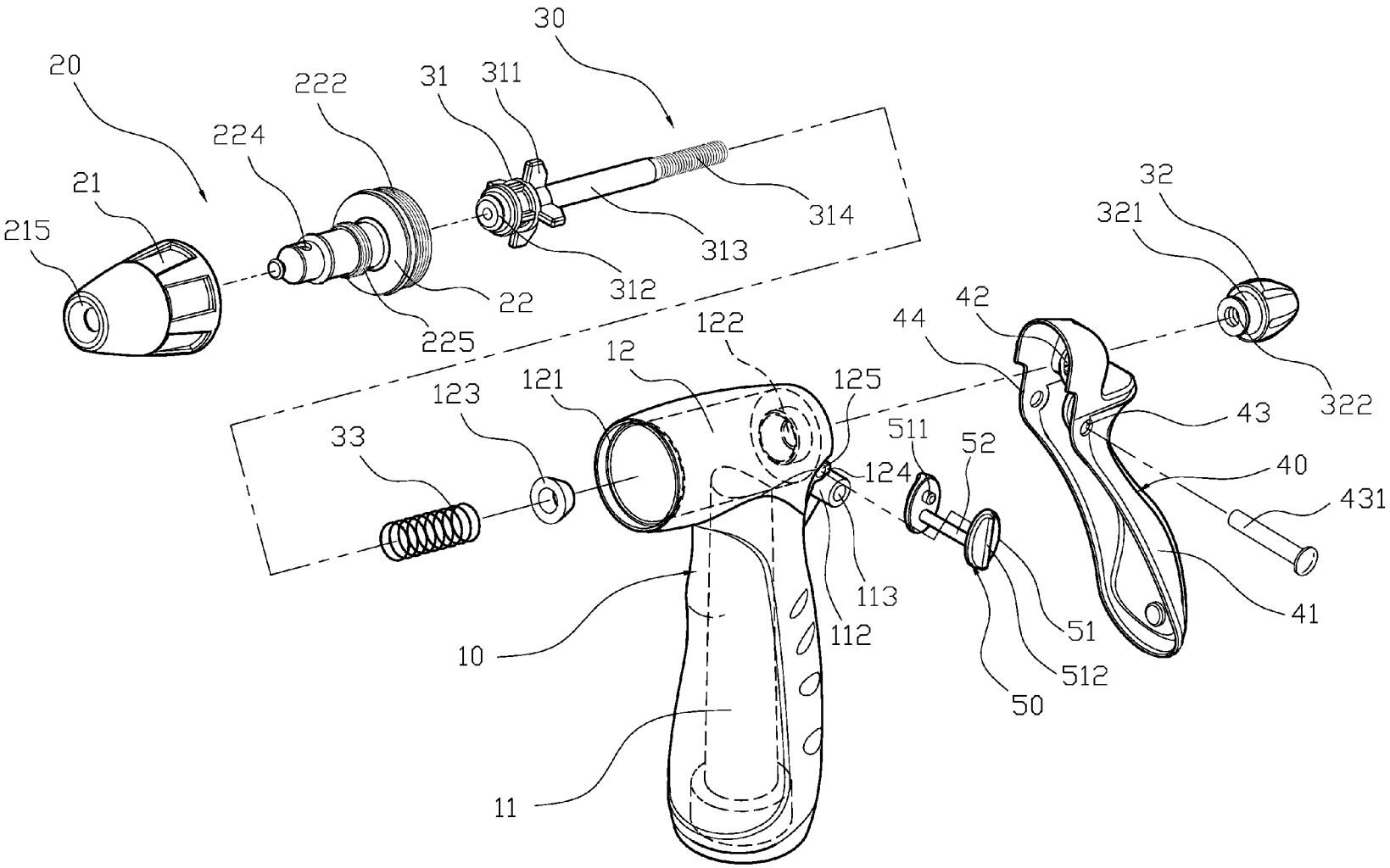
FIG. 2 is an exploded view of an embodiment of the present invention.
Figure 3:
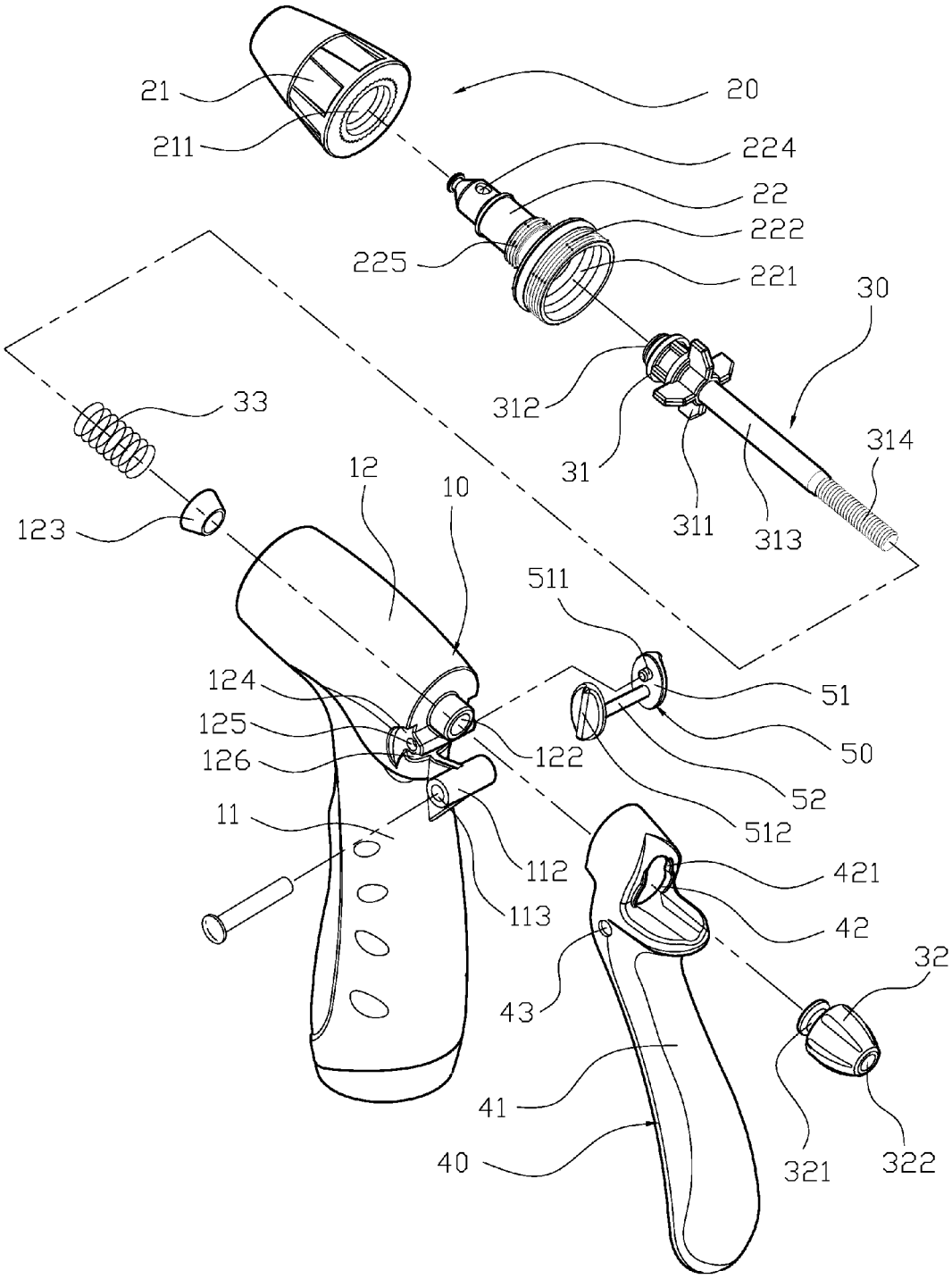
FIG. 3 is another exploded view of an embodiment of the present invention.
Figure 4:
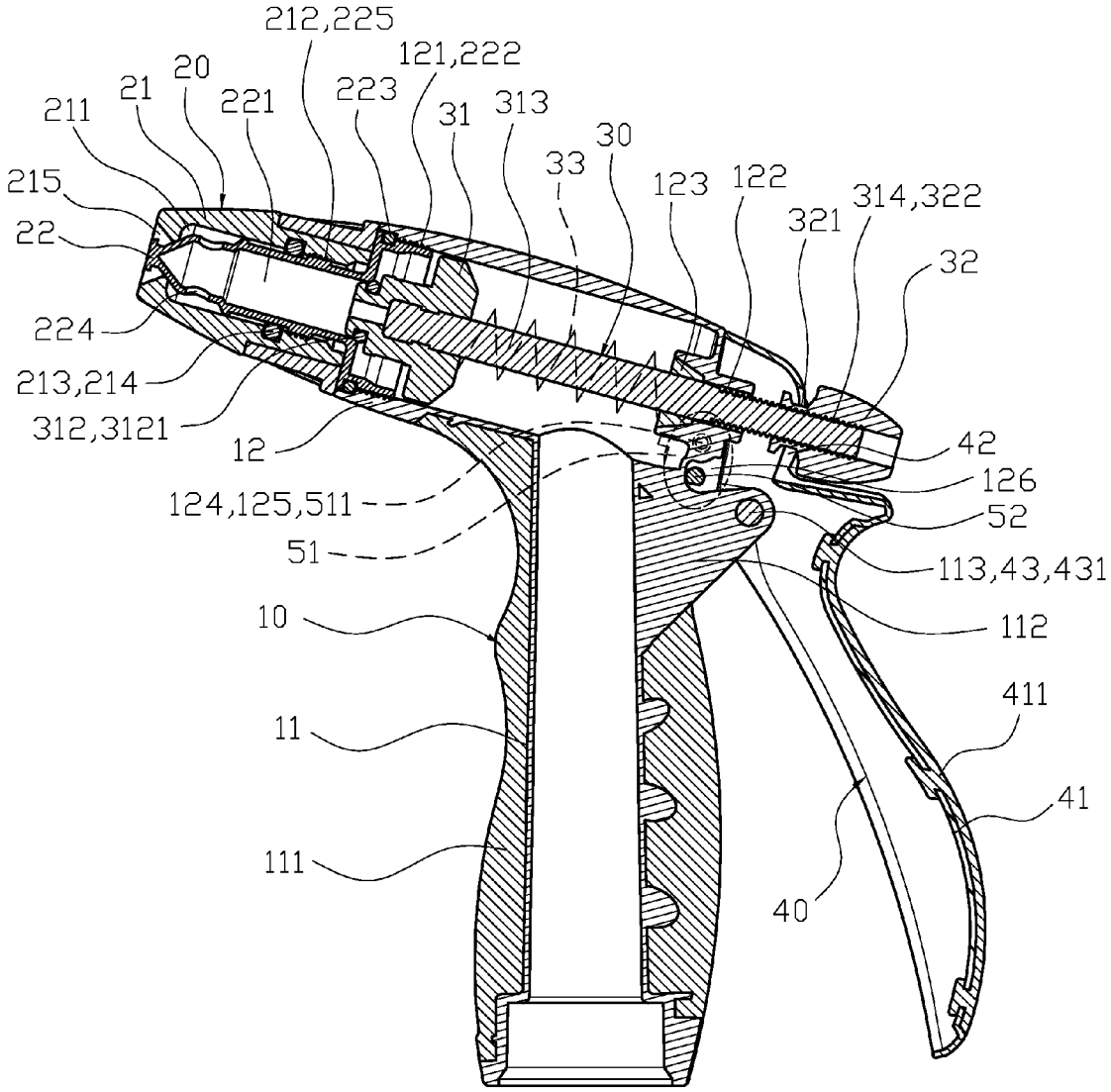
FIG. 4 is a cross-sectional view of an embodiment of the present invention.

Please refer to FIG. 1, FIG. 2 and FIG. 4. A garden sprayer comprises a main body 10, a spray head 20, a control valve set 30, a pressing handle 40 and a fastening device 50. The main body 10 has a hand-held tube 11, and the hand-held tube 11 is covered by an anti-slip cover 111 and has a pivoting base 112 at a rear end. The pivoting base has a shaft aperture 114. A flow tube 12 is connected to an upper end of the hand-held tub 11, and the flow tube 12 has a first locking edge 121 at an end. An assembling aperture 122 is disposed at an opening face of the main body 10, a pivoting portion 124 is formed adjacent to the assembling aperture 122, a sealing washer 123 is inserted into the assembling aperture 122 of the main body 10, and the pivoting portion 124 has a through aperture 125. The pivoting portion 124 of the main body 10 is disposed apart from the pivoting base 112 to form a third containment space 126, as shown in FIG. 3. The spray head 20 has a cover 21 and a head portion 22, and the cover 21 has a first containment space 211. The first containment space 211 has a threaded section 212 and a spraying aperture 215. The spray head 20 further includes a securing slot 213 adjacent to the threaded section 212, for accepting a sealing ring 214. The spraying aperture 215 of the cover 21 is tapered. The head portion 22 is hollow and has a second containment space 221, the second containment space 221 has a second locking edge 222, and the second locking edge 222 is engaged with the first locking edge 121 of the main body 10. The second containment space 221 further has a respective outlet aperture 224 at each side and an adjusting thread section 225 adjacent to the outlet aperture 224, and the adjusting thread section 225 is secured onto the threaded section 212 of the cover 20. The control valve set 30 has a valve member 31, a securing member 32 and an elastic member 33. The valve member 31 has a plug 312 formed at an end, the plug 312 is insertable to seal the second containment space 221, and the plug 312 is jacketed with a sealing ring 3121. The valve member 31 further has an extended rod 313 at another end, and the extended rod 313 has a securing section 314. The securing member 32 has a first engaging slot 321 and a threaded aperture 322, and the threaded aperture 322 engages with the securing section 314 of the extended rod 313. The elastic member 33 jackets onto the extended rod 313 of the valve member 31, and the elastic member 33 pushes against an opening side of the flowing tube 12 of the main body 10 and the valve member 31. The pressing handle 40 has a handle portion 41, and the handle portion 41 is covered by an anti-slip pad 411 and has a through hole 42 above an opening of the handle portion 41. The through hole 42 accepts the securing member 32, and the through hole 42 further has a second engaging slot 421, as shown in FIG. 3. The second engaging slot 421 engages with the first engaging slot 321 of the securing member 32 and has a pivoting aperture 43 on a side. The pivoting aperture 43 is provided with a pin 431, and the pin 431 passes through the shaft aperture 113 of the pivoting base 112 and has a third locking edge 44 adjacent to the pivoting aperture 43. The fastening device 50 comprises at least two brackets 51 and a pressing rod 52 connecting the two brackets 51. An engaging rib 511 is formed on an inner side of the bracket 51, and the engaging rib 511 is pivoted onto the through aperture 125 of the pivoting portion 124 of the main body 10. The bracket 51 of the fastening device 50 further has a raised portion 512 on an outer side. The pressing rod pushes against the third locking edge of the pressing handle, and pressing rod 52 of the fastening device 50 further has a pushing face 521.

For structural assembly, please refer to FIG. 4 with FIG. 2. First, the two brackets 51 of the fastening device 50 are pushed apart from each other to make the engaging rib 511 of the bracket 51 able to pivot with the through aperture 125 of the pivoting portion 124 of the main body 10 and the pressing rod 52 of the fastening device 50 be disposed in the third containment space 126 of the main body 10, such that the pivoting aperture 43 of the pressing handle 40 and the shaft aperture 113 of the pivoting base 112 of the main body 10 is aligned with each other and both inserted with the pin 431. Therefore, the elastic member 33 is jacketed onto the extended rod 313 of the valve member 31, the valve member 31, the extended rod 313 and the elastic member 33 are all placed in the flowing tube 12 of the main body 10, the extended rod 313 of the valve member 31 is placed through the flowing tube 12 and the through hole 42 of the pressing handle 40, and the threaded aperture 322 of the securing member 32 is secured to the securing section 314 of the extended rod 313 such that both ends of the elastic member 33 respectively push the opening side of the flowing tube 12 of the main body 10 and the valve member 31. Furthermore, the head portion 22 is placed in the first containment space 211 of the cover 21, the adjusting thread section 225 of the head portion 22 is screwed onto the threaded section 212 of the cover 21 to complete the assembly of the spray head 20. Afterward, the second locking edge 222 of the head portion 22 of the spray head 20 is locked onto the first locking edge 121 of the flowing tube 12 of the main body 10.

Figure 5:
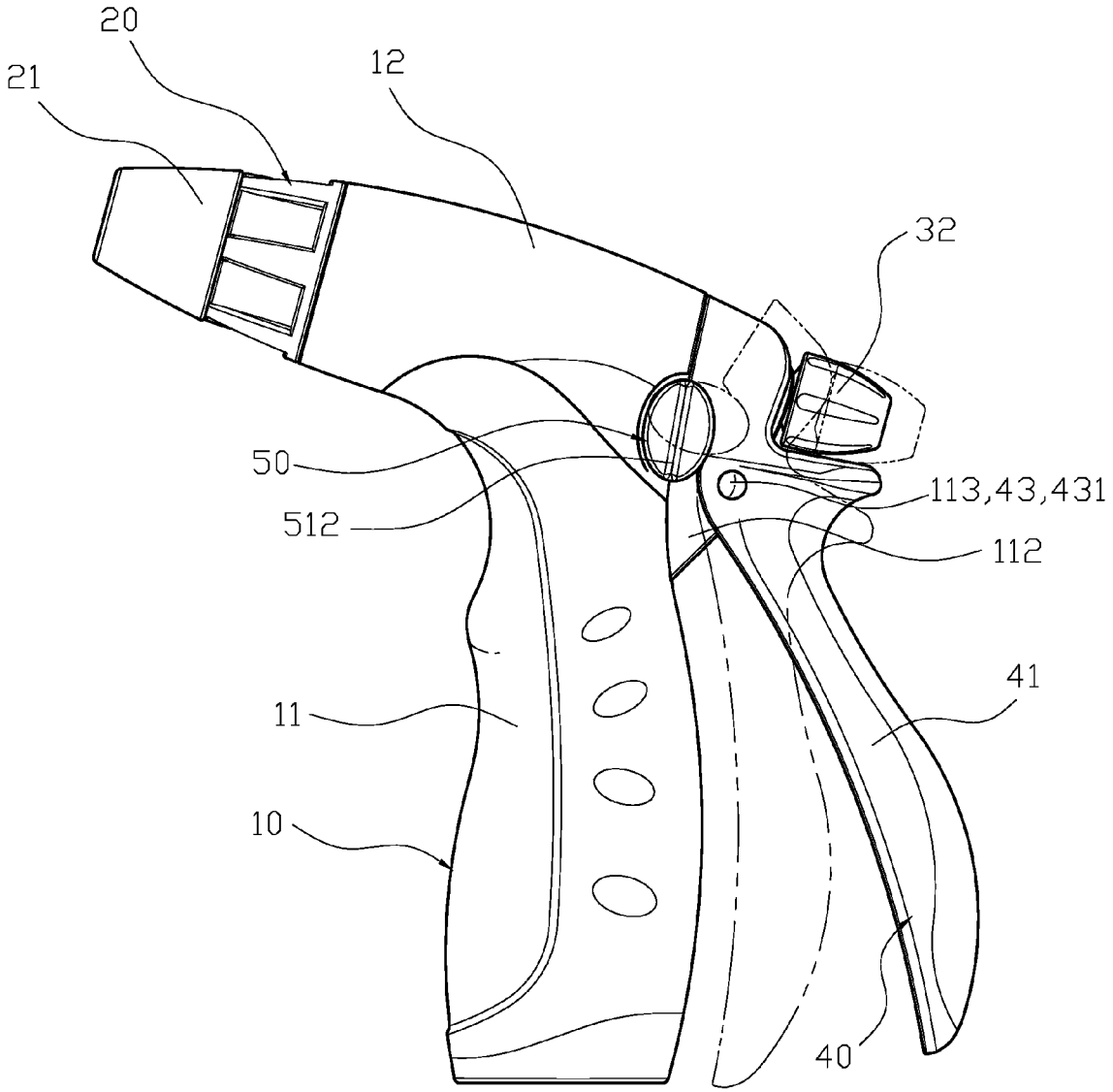
FIG. 5 shows usage of an embodiment of the present invention.
Figure 6:
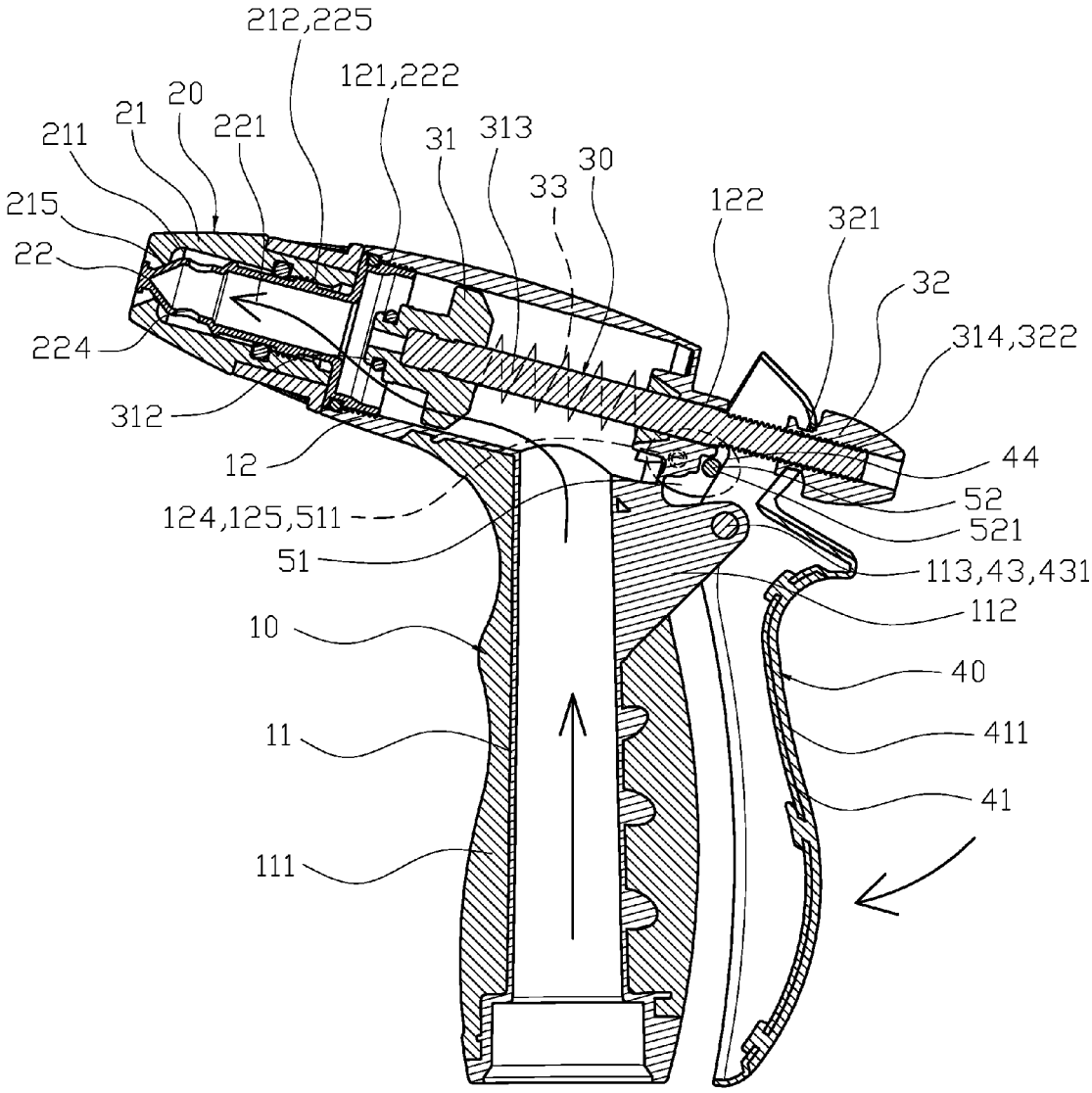
FIG. 6 is another cross-sectional view of an embodiment of the present invention.
Figure 7:
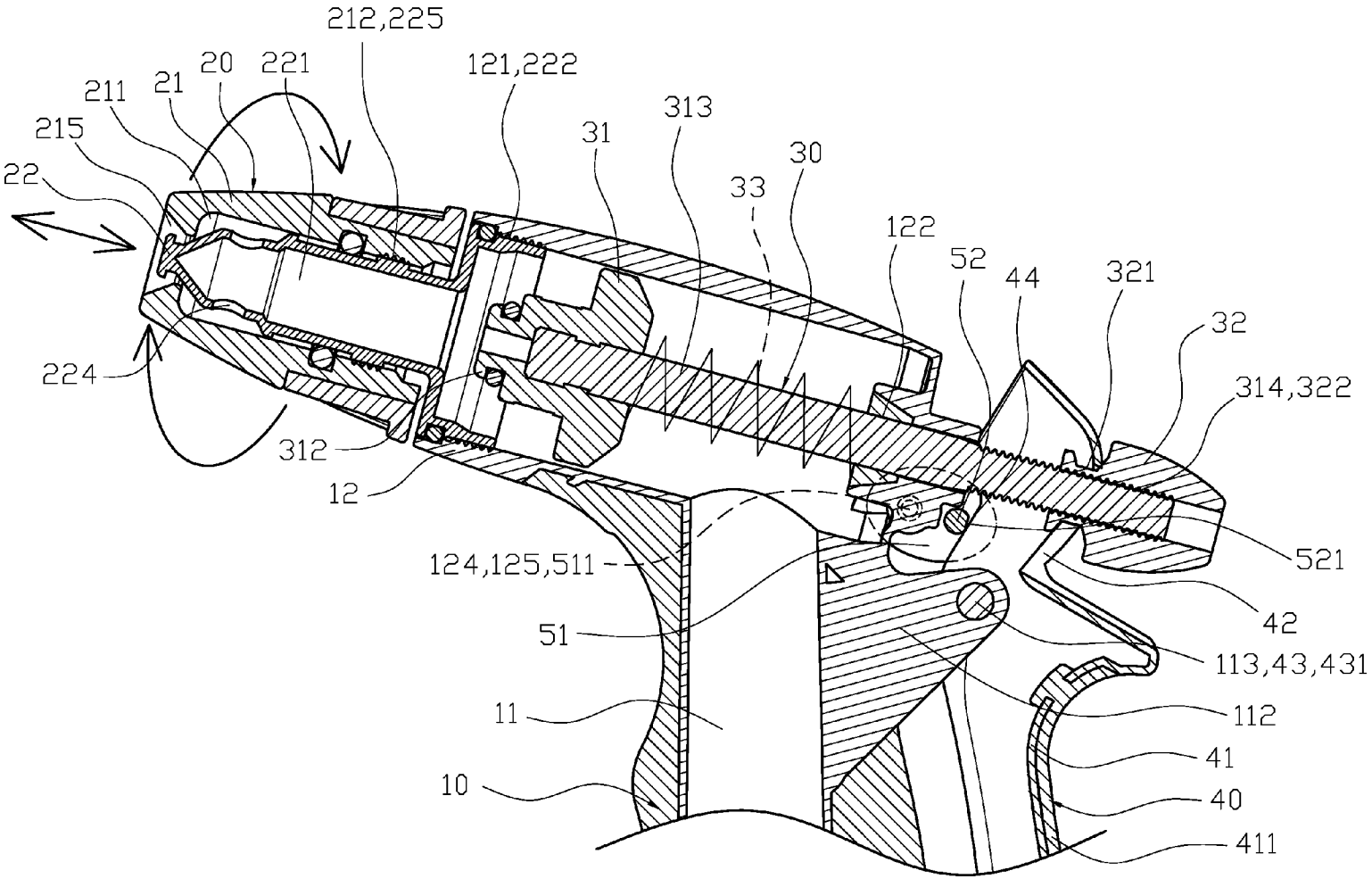
FIG. 7 shows the outlet flow being adjustable.

For use, please refer to FIG. 4 and FIG. 6 with FIG. 3. In order to begin spraying, the user presses down upon the pressing handle 40 to rotate the pressing handle 40 around the pin 431, as shown in FIG. 5. Accordingly, the first engaging slot 321 of the securing member 32 and the second engaging slot 421 of the pressing handle 40 engage with each other. Consequently, the pressing handle 40 also pulls the extended rod 313 of the control valve set 30 backwards during the handle rotation and compresses the elastic member 33 to cause the plug 312 of the valve member 31 to escape from the opening of the second containment space 221 of the head portion 22, such that the second containment space 221 of the head portion 22 and the flow tube 12 of the main body 10 are connected. Water then flows through the hand-held tube 11 of the main body 10, the flow tube 12 and the second containment space 221 of the head portion 22, and then flows through the outlet aperture 224 to spray from the spraying aperture 215 of the cover 21. Meanwhile, the fastening device 50 rotates upwardly around the through aperture 125 of the pivoting portion 124, and as a result the pressing rod 52 of the fastening device 50 escapes from the third containment space 126 of the main body 10, and the pressing rod 52 of the fastening device 50 pushes against the third locking edge 44 of the pressing handle 40 to cause the pressing handle 40 to be held down for constant water flow without the pressing handle 40 needing to be pressed down by the user. Furthermore, when the pressing handle 40 is held down, the cover 21 of the spray head 20 can be rotated to adjust a gap between the spraying aperture 215 of the cover 21 and the head portion 22 to adjust the water flow, as shown in FIG. 7. Moreover, the pressing rod 52 has a pushing face 521 which helps the pressing rod 52 to push against the third locking edge 44 of the pressing handle 40 to prevent the fastening device 50 from escaping. To stop spraying, the user presses down upon the pressing handle 40 again to cause the third locking edge 44 of the pressing handle 40 to leave the pressing rod 52 of the fastening device 50, such that the pressing rod 52 of the fastening device 50 automatically swings back into the third containment space 126 of the main body 10 due to the gravity. Therefore, the user can release the pressing handle 40 to cause the valve member 31 of the control valve set 30 to be pushed by the elastic member 33 such that the plug 312 of the valve member 31 pushes against the opening of the second containment space 221 of the head portion 22 to seal off water. Meanwhile, the elastic member 33 causes the securing member 32 of the extended rod 313 to drive the pressing handle 40 to swing in an opposite direction to return back to the original position, as shown in FIG. 4.

With the above-mentioned embodiment, the following benefits can be obtained: 1. During the spraying, the pressing rod 52 of the fastening device 50 escapes from the third containment space 126 of the main body 10 and the pressing rod 52 of the fastening device 50 pushes against the third locking edge 44 of the pressing handle 40 to hold down the pressing handle 40 for a constant water flow without the pressing handle 40 needing to be pressed by the user. 2. When the pressing handle 40 is held down, the cover 21 of the spray head 20 can be rotated to adjust a gap between the spraying aperture 215 of the cover 21 and the head portion 22 to adjust the water flow rate.

Although the present invention has been explained in relation to its preferred embodiment, it is to be understood that many other possible modifications and variations can be made without departing from the spirit and scope of the invention as hereinafter claimed.

What is claimed is:

1. A garden sprayer comprising:

a main body having a hand-held tube, the hand-held tube covered by an anti-slip cover and having a pivoting base at a rear end; the pivoting base having a shaft aperture; a flow tube connected to an upper end of the hand-held tub, the flow tube having a first locking edge at an end; an assembling aperture disposed at an opening face of the main body, a pivoting portion formed adjacent to the assembling aperture, and the pivoting portion having a through aperture;

a spray head having a cover and a head portion, the cover having a first containment space, the first containment space having a threaded section and a spraying aperture; the head portion being hollow and having a second containment space, the second containment space having a second locking edge, the second locking edge being engaged with the first locking edge of the main body, the second containment space further having a respective outlet aperture at each side and an adjusting thread section adjacent to the outlet aperture, and the adjusting thread section being secured onto the threaded section of the cover;

a control valve set having a valve member, a securing member and an elastic member, the valve member having a plug formed at an end, the plug being insertable to seal the second containment space, the valve member further having an extended rod at another end, the extended rod having a securing section, the securing member having a first engaging slot and a threaded aperture, the threaded aperture engaging with the securing section of the extended rod, the elastic member jacketing onto the extended rod of the valve member, the elastic member pushing against an opening side of the flowing tube of the main body and the valve member;

a pressing handle having a handle portion, the handle portion covered by an anti-slip pad and having a through hole above an opening of the handle portion, the through hole accepting the securing member, the through hole further having a second engaging slot, the second engaging slot engaging with the first engaging slot of the securing member and having a pivoting aperture on a side, the pivoting aperture provided with a pin, the pin passing through the shaft aperture of the pivoting base and having a third locking edge adjacent to the pivoting aperture; and a fastening device comprising at least two brackets and a pressing rod connecting the two brackets, an engaging rib formed on an inner side of the bracket, the engaging rib pivoted onto the through aperture of the pivoting portion of the main body, and the pressing rod pushes against the third locking edge of the pressing handle.

2. The garden sprayer as claimed in claim 1, wherein a sealing washer is inserted into the assembling aperture of the main body.

3. The garden sprayer as claimed in claim 1, wherein the pivoting portion of the main body is disposed apart from the pivoting base to form a third containment space, and the third containment space is used for accepting the pressing rod of the fastening device.

4. The garden sprayer as claimed in claim 1, wherein the spray head further includes a securing slot adjacent to the threaded section.

5. The garden sprayer as claimed in claim 1, wherein the spraying aperture of the cover is tapered.

6. The garden sprayer as claimed in claim 1, wherein the second locking edge of the head portion is jacketed with a sealing ring.

7. The garden sprayer as claimed in claim 1, wherein the valve member further has at least one rib board.

8. The garden sprayer as claimed in claim 1, wherein the plug of the valve member is jacketed with a sealing ring.

9. The garden sprayer as claimed in claim 1, wherein the bracket of the fastening device further has a raised portion on an outer side.

10. The garden sprayer as claimed in claim 1, wherein the pressing rod of the fastening device further has a pushing face.

* * * * *